United States Patent [19]

Praprotnik

[11] 4,222,376

[45] Sep. 16, 1980

[54] EXERCISE MACHINE

[76] Inventor: Louis Praprotnik, 5500 Lindenwood Ave., St. Louis, Mo. 63109

[21] Appl. No.: 72,898

[22] Filed: Sep. 6, 1979

[51] Int. Cl.[3] ..... A61H 1/02

[52] U.S. Cl. ..... 128/25 R; 272/73

[58] Field of Search ..... 128/25 R, 24 R, 24.1; 272/73

[56] References Cited

U.S. PATENT DOCUMENTS

| | | | |
|---|---|---|---|
| 1,909,002 | 5/1933 | Oehberg | 128/25 R |
| 2,020,992 | 11/1935 | Caplan | 128/25 R |
| 2,226,881 | 12/1940 | Voiles | 128/25 R |
| 3,212,776 | 10/1965 | Bassler | 272/73 |
| 3,213,852 | 10/1965 | Zent | 128/25 R |
| 3,216,722 | 11/1965 | Odom | 128/25 R |
| 3,824,993 | 7/1974 | Grant | 128/25 R |
| 3,991,749 | 11/1976 | Zent | 128/25 R |
| 4,084,810 | 4/1978 | Forsman | 272/73 |

*Primary Examiner*—Lawrence W. Trapp

[57] ABSTRACT

An exercise machine for restoring lost movement to joints and muscles includes a base to which a chair upon which the user is seated may be mounted, to prevent the machine from tipping, and includes a vertical standard mounting a rotatable handlebar assembly and a crank assembly. The handlebar assembly includes a sloping stem rotatable on the vertical standard and handlebars rotatable on the upper sloping end of the stem, whereby propelling the handlebars about for a circular path of the stem upper end provides a wide range of movement to the arms and upper torso. The crank assembly is made up of upper and lower bicycle-type crank mechanisms, for the arms and legs, coupled by a V-belt so that strong, readily moved legs may be utilized to restore movement to arms whose range of movement is impaired, or vice-versa.

6 Claims, 4 Drawing Figures

EXERCISE MACHINE

BACKGROUND OF THE INVENTION

The present invention relates to exercise machines, and specifically to exercise machines used in the treatment of arthritis and other medical conditions of limitation of movement of the arms, shoulder, legs and spine.

For many such conditions, a particularly helpful treatment is simple exercise of the affected joints and muscles. For this purpose, various types of exercise machines have been provided, including bicycle-type machines for the legs and machines provided with levers or light-weight pulls for the arms. Frequently these conditions do not affect all of the limbs.

SUMMARY OF THE INVENTION

A primary purpose of the present invention is to provide an exercise machine for the treatment of arthritic persons by which both the arms and legs may be exercised simultaneously, or by which one limb may be utilized to impart movement to others. Another purpose is to provide an exercise machine which will provide for spinal movements. Still another purpose is to provide an exercise machine for which the user may sit on an ordinary chair, or lie in bed.

Briefly summarized, the present invention comprises a base having sockets which will accept and secure the lower ends of the legs of a chair. A vertical standard extends upward from the base to an upper end which supports for rotation a slanting stem member, which slopes upward and outward to an upper end which supports for rotation bicycle-type handlebars. By propelling the handlebars about, the upper end of the stem member may be made to trace a circular path, stretching the spine and bending both arms over a wide range of movement.

A first bicyle-type crank assembly, provided with foot pedals, is supported, below the stem member by the vertical standard, at the lower end of an arm member which extends upward and outward from the standard. A second bicycle-type crank assembly is mounted at the outer end of the arm and is provided with handgrips. The two crank assemblies are operably coupled by a pair of pulleys and a belt, whereby rotation of one crank rotates the other, so that a stronger, readily moved limb may be utilized to impart movement to other weaker limbs whose range of movement is impaired.

DESCRIPTION OF THE PREFERRED EMBODIMENT

Figure 1:
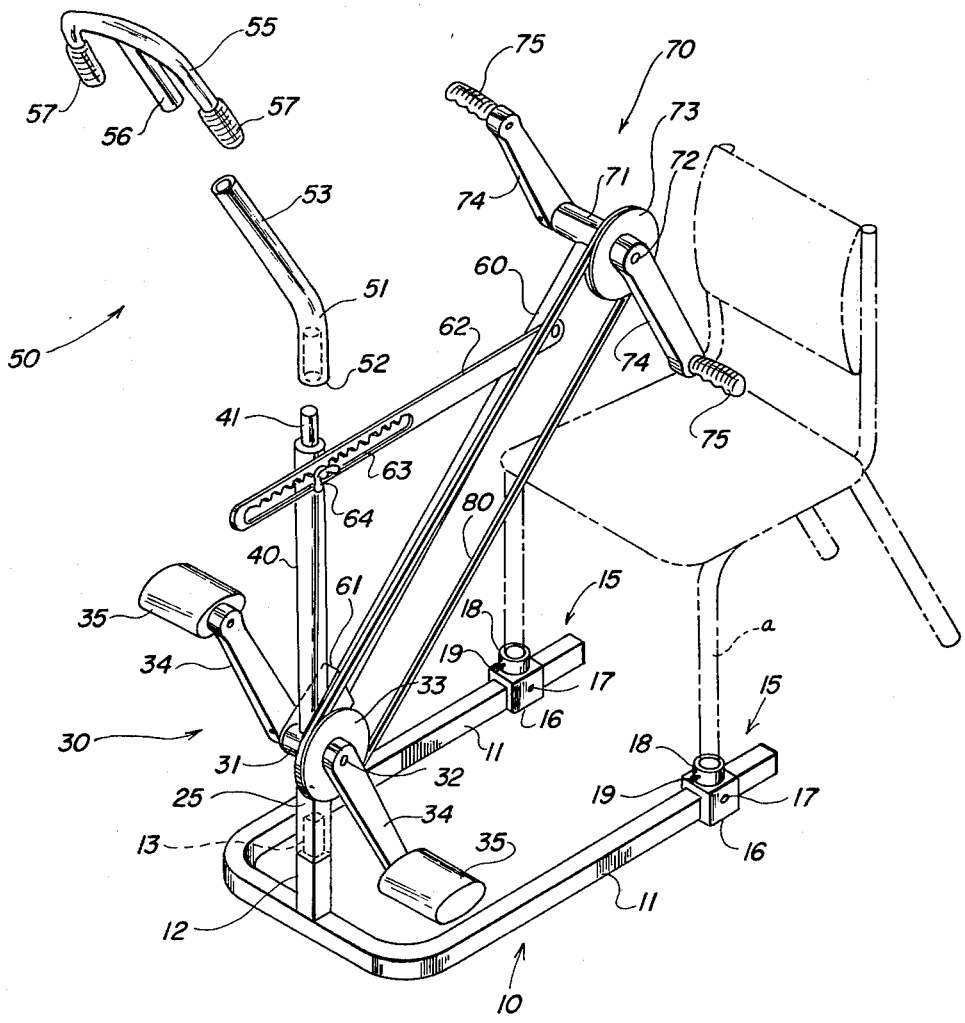
FIG. 1 is a isometric drawing of a preferred embodiment of the present exercise machine shown with its handlebar mechanism exploded and with a chair, utilized with the exercise machine, shown in phantom lines.

As shown in FIG. 1, the preferred embodiment of the present exercise machine is comprised of a base assembly, generally designated 10, to which a chair a, or other leg-supported seating furniture, may be mounted, a vertical standard hereafter referred to which supports a lower bicycle-type crank assembly, generally designated 30, and an upper rotatable handlebar mechanism, generally designated 50. A support arm 60 mounts an upper bicycle-type crank assembly, generally designated 70, coupled by V-belt drive to the lower crank assembly 30.

Described in detail, the base assembly 10 is U-shaped and includes a pair of parallel, horizontally-extending legs 11, of square tubing, and an upright support member 12 of similar tubing, mounted at the midpoint between the legs 11, with a smaller cross-section square post 13 extending upward from the upper end of the member 12. Each leg 11 mounts a slidable socket assembly 15 comprised of a square tube segment 16 slidable upon the legs 11 and fixed in position by a setscrew 17, and further comprised of an upward-extending socket portion 18 on the tube 16 into which the lower ends of the legs of the chair a are clamped by a setscrew 19.

The post 13 of the base assembly upright support member 12 accepts the lower end of a vertical standard lower section 25, which is of square tubing.

The lower bicycle-type crank assembly 30 is mounted at the upper end of the vertical standard lower section 25 by a bearing support 31. A shaft 32 extends through the bearing support 31, having a V-belt pulley 33 and bicycle-type crank arm 34 mounted on one end outward of the support 31 and a similar crank arm 34 on its opposite end outward of the support 31. Both crank arms 34 are equipped with bicycle-type foot pedals 35.

A vertical standard upper section 40, made up of a cylindrical tube, continues upward from the lower crank bearing support 31. A reduced-diameter cylindrical post 41 extends upward from the upper end of the vertical standard upper section 40.

The rotatable handlebar mechanism 50 includes a stem member 51 mounted by its lower end 52 onto the vertical standard cylindrical post 41 so as to be rotatable about its vertical axis. The stem member 51 has a sloping upper portion 53, sloping upward and outward from above the upper end of the post 41, inclined from vertical at an angle which in the embodiment shown is approximately 40°. Bicycle-type handlebars 55 are rotatably mounted to the sloping upper end 53 of the stem member 51 by a downward-extending center-mounted cylindrical post 56 fitted for pivoting in the stem member sloping upper portion 53. The outward-extending ends of the handlebars 55 are preferably inclined at a small angle from the post 56 as shown in FIG. 1, and have handgrips 57.

An upper crank mechanism support arm 60 slopes upward from the lower crank assembly 30, having a clevis 61 at its lower end pivotally engaged to the lower crank assembly support bearing 31 about the upper and lower sections of the vertical standard 25, 40. A support strut 62 is pinned to the support arm and extends to the vertical standard upper section 40 upward of the lower crank assembly 30. The support strut 62 has a lengthwise-extending upwardly-notched slot 63 through which the strut is adjustably secured to the upper section vertical standard 40 by a wingbolt 64 secured in one of its notches.

The upper bicycle-type crank assembly 70 is mounted at the upper end of the support arm 60 by a support bearing 71, which supports a horizontal shaft 72 mounting a V-belt pulley 73, aligned with the pulley 33 of the lower crank assembly 30, and a pair of crank arms 74 with projecting handgrips 75. The crank arms 74, or alternatively the handgrips 75, may be removable during use of the handlebar mechanism 50.

A V-belt 80 couples the V-belt pulley 73 of the upper crank 70 to the V-belt pulley 33 of the lower crank assembly 30, so that rotation of either crank assembly drives the other. Where such operation is not desired, the V-belt 80 may be removed.

Figure 2:
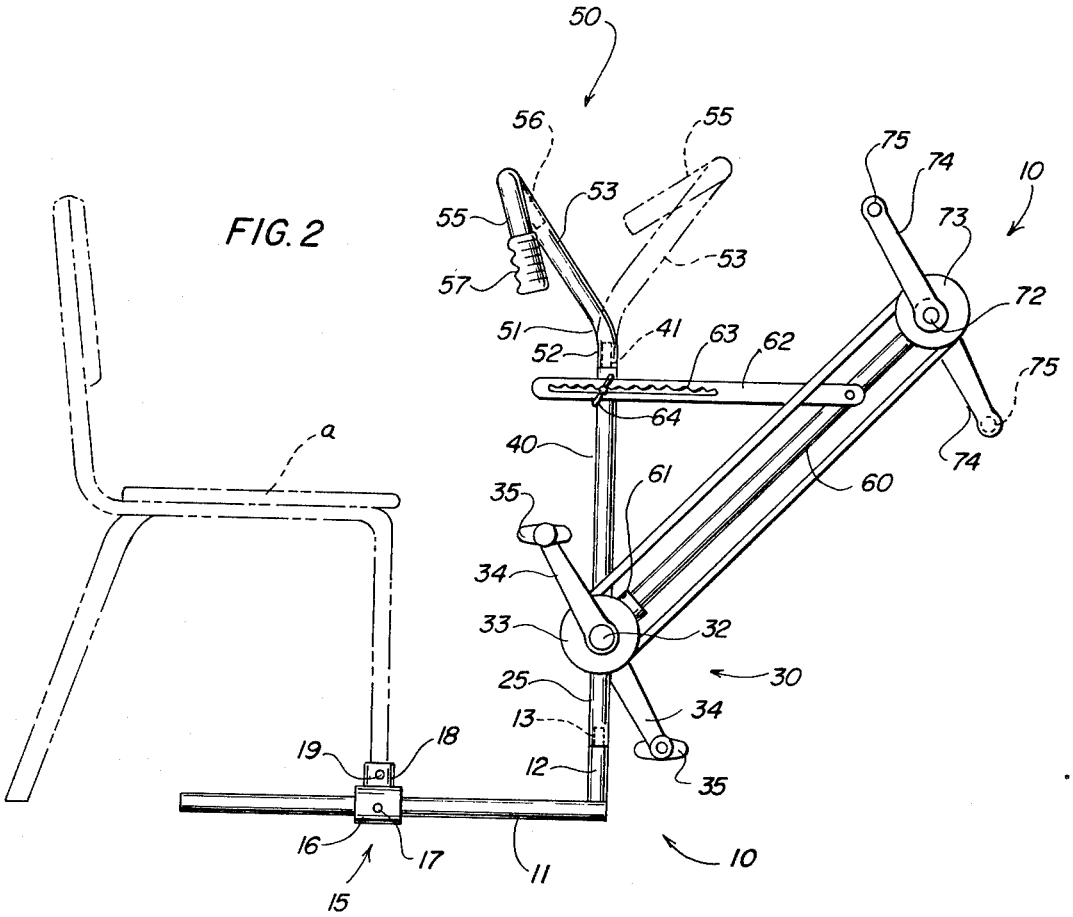
FIG. 2 is a side elevation of the exercise machine of FIG. 1, showing the machine rotated 180° on its base with a chair in phantom lines fixed to the base, and in phantom lines showing the handlebar mechanism rotated one-half revolution from its position shown in solid lines.

In the above-described preferred embodiment, the exercise machine may be utilized from either side, as contrasted by FIGS. 1 and 2. This is made possible by the square conformation of the lower section vertical standard 25 which receives the smaller square post 13 of the base upright support member 12. The vertical standard lower section 25 may be so mounted onto the post 13 on the base assembly 10 with the support arm 60 extending either in the direction of the horizontally-extending legs 11, as when the upper crank assembly 70 is to be utilized as shown in FIG. 1, or in the opposite direction when the handlebar mechanism 50 is to be utilized, as shown in FIG 2.

In use of the rotatable handlebar mechanism 50, as shown in FIG. 2, the vertical standard lower section 25 is mounted onto the base assembly post 13 with the support arm 60 rotated 180° from the direction of extension of the base assembly legs 11. The lower end of the two front legs of a chair a are clamped by the setscrews 19 into the socket portions of the slidable socket assemblies 15; the chair is then slided along the legs 11 until at the proper spacing from the vertical standard and the setscrews 17 on the socket assembly tube segments 16 are tightened. Alternatively, the legs 11 may be slid between the mattress and springs of a bed for use of the exercise machine while lying in bed; this use may require an extension between the base assembly post 13 and vertical standard lower section 25. Where the user desires to exercise while seated in an overstuffed armchair, the legs 11 may be slid under the lower end of the chair, which is generally spaced closely to the floor.

Figure 3:
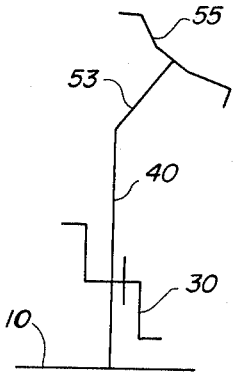
FIG. 3 is a schematic line drawing taken from the position of one seated on the chair as in FIG. 2 and showing the handlebar mechanism rotated one-fourth revolution to the right.
Figure 4:
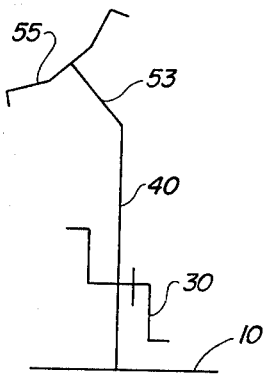
FIG. 4 is a line drawing, similar to FIG. 3, showing the handlebar mechanism rotated one-fourth revolution to the left.

For the positions of the components shown in FIG. 2, the rotatable handlebar mechanism 50 provides a novel exercise motion for the arms and upper torso. This is made possible by the double-rotatable construction of the handlebar mechanism 50; the handlebars 55 rotate about the slanting axis of the stem member 51, while the lower end 52 of the stem member 51 rotates on the vertical axis of the upper section vertical standard 40. The user grasps the handgrips 57, beginning at the position of the handlebar mechanism 50 shown in solid lines in FIG. 2, at which the stem member 51 slopes toward the user and the handgrips 57 extend generally downward. By pushing the handlebars 55 to the right but holding them so that they continuously face the user, the stem member 51 is rotated on the vertical standard 40 as the handlebars 55 rotate on the stem member 51; after one-fourth turn, the handlebar mechanism 50 is substantially inclined to the right, as shown in FIG. 3. On continued rotation, after one-half revolution the handlebar mechanism 50 is in the position shown in phantom lines in FIG. 2, with the stem member 51 sloping away from the user and the handgrips 57 extending generally toward the user. Further continued rotation to the user's left inclines the handlebar mechanism 50 to the left, as at the three-quarter revolution position shown in FIG. 4. Continued rotation of the mechanism returns it to the beginning position shown in solid lines in FIG. 2.

By propelling the handlebar mechanism 50 in the described path, with the upper end of the sloping stem portion 53 tracing a circular path, the joints and muscles of the back and arms are exercised. Little resistance to motion is provided, the purpose of the exercise being simply to direct movement of the body over a wide range, to restore motion to the arms and upper torso which may have been impaired due to arthritis or other disease. The legs may be exercised simultaneously by use of the lower crank assembly 30.

For the alternative use of the exercise machine of the preferred embodiment, the vertical standard lower section 25 is instead slided onto the base assembly 10 with the support arm 60 extending toward the legs 11, rotated 180° from the position for the use described above. The chair a is then clamped onto the socket assemblies 15, which are adjusted for the proper spacing between the chair and the lower crank assembly 30. The inclination angle of the support arm 60 may be adjusted by loosening the wingbolt 64 and sliding the strut 62 to the proper notched position in the lengthwise slot 63, and then retightening the wingbolt 64, to position the upper crank assembly 70 at the desired position. Again, where it is desired to exercise while lying in bed, the legs 11 may instead be slided between the bed spring and mattress.

In this alternative use, the user may be seated on the chair a and utilize his feet on the pedals 35 of the lower crank assembly 30 for exercise of the legs and utilize his hands on the handgrips 75 of the upper crank assembly 70 for exercise of the arms and shoulders, preferably where the V-belt 80 has been removed for independent rotation of the upper and lower crank assemblies. When certain limbs have impaired movement due to arthritis or other disease for which exercise may be prescribed, one or more healthy limbs may be utilized to impart movement to those limbs with a limited range of movement, with the V-belt 80 in place. For example, where a person's arms are affected by arthritis, but his legs are substantially unimpaired, he may grasp the handgrips 57 while pedaling the lower crank assembly 30, causing the arms to be directed through a substantial range of movement. Such exercise may render movable joints stricken by arthritis and strengthen muscles weakened by other disease.

Modifications of the above-described preferred embodiment of the exercise machine will be obvious to persons skilled in the art. For example, any means to adjust the angle of the support arm relative to the vertical standard may be utilized, as well as any means operable between the lower and upper crank assemblies to cause rotation of one crank assembly on rotation of the other, such as a chain and sprocket arrangement. The base assembly may have any means to support the vertical standard either in a first angular position in which the crank assembly is to be utilized, or in a second angular position 180° removed therefrom, where the handlebar mechanism is to be utilized. The base may be modified for use with any type seating means having a floor support portion accepted by socket means on the base assembly; or for insertion between the spring and mattress of a bed on which the user is seated or lying. From these examples, other modifications will suggest themselves.

What is claimed is:

1. An exercise machine by which persons may exercise while seated on seating means having a floor support portion, comprising A. a substantially vertical standard, B. a handlebar mechanism including a stem member mounted rotatably at the upper end of the vertical standard on a vertical axis and sloping upward therefrom, ending in a sloping upper end, and outward extending handlebars, mounted rotatably along a sloping axis at the upper end of the stem member, C. a crank mechanism including a support arm mounted on the vertical standard at a point below its upper end and sloping upward therefrom, means to adjust the angle of the arm relative to the standard, a lower crank assembly mounted adjacent to the lower end of the arm, the lower crank assembly having foot pedals, an upper crank assembly mounted adjacent to the upper end of the arm, the upper crank assembly having handgrips, and means operable between the lower and upper crank assemblies to cause rotation of one crank assembly on rotation of the other, the exercise machine further comprising D. a base assembly including a base having means to support the vertical standard either in a first angular position, in which the crank assembly is to be utilized, or in a second angular position 180° removed therefrom, and socket means on the base remote from the support means and positioned genrally in the direction of said first angular position, to accept the floor-support portion of the seating means, whereby the weight of a person seated on the seating means prevents the exercise machine from tipping, and such person may utilize the crank assembly for exercising the arms or legs or both, or alternately utilize the handlebar mechanism without interference from the crank mechanism.

2. An exercise machine comprising a base, a substantially vertical standard extending upward from the base, a stem member mounted rotatably at the upper end of the vertical standard on a vertical axis and sloping upward therefrom, ending in a sloping upper end, and further comprising handlebars mounted rotatably to the sloping upper end of the stem member, the handlebars having outer handgrip portions, whereby the machine may be utilized by grasping the handlebar handgrip portions and so propelling the handlebars about that the upper end of the stem member traces a circular path.

3. The exercise machine defined in claim 2, and further comprising a bicycle-type crank assembly supported by the vertical standard below the level of the stem member, the crank assembly having foot pedals, whereby to permit simultaneous exercise of both the legs and arms.

4. The exercise machine defined in claim 3, and further comprising a support arm extending outward and upward from the vertical standard, a second bicycle-type crank assembly supported adjacent to the outer end of the arm member, the second crank assembly having handgrips, and comprising means, operable between the lower and upper crank assemblies, to cause rotation of one crank assembly on rotation of the other, whereby a strong, readily moved limb may be utilized to impart movement to other weaker limbs whose range of movement is impaired.

5. The exercise machine defined in claim 2, for use with leg-supported seating furniture upon which a person may be seated during exercise, and further comprising a base for the vertical standard, socket means, on the base, to accept and secure the lower ends of the legs of the seating furniture, whereby the weight of the person prevents the exercise machine from tipping.

6. An exercise machine comprising a substantially vertical standard, a stem member mounted rotatably at the upper end of the vertical standard and sloping upward and outward therefrom, handlebars mounted rotatably to the upper end of the stem member, the handlebars having outer handgrip portions, a support arm extending slopingly upward from the vertical standard, a first bicycle-type crank assembly, supported by the standard, the first crank assembly having foot pedals, a second bicycle-type crank assembly mounted on the support arm adjacent to its outer end, above the level of the first crank assembly, the second crank assembly having handgrips, means, operable between the lower and upper crank assemblies, to cause rotation of one crank assembly on rotation of the other.

* * * * *